US005809155A

United States Patent [19]

Su

[11] Patent Number: 5,809,155

[45] Date of Patent: Sep. 15, 1998

[54] ASSEMBLING STRUCTURE FOR CAPACITOR MICROPHONE

[76] Inventor: Den-Tsai Su, No.2-1,Lane 188,Lian Cherng Rd., Jong Her City,Taipei Hsien, Taiwan

[21] Appl. No.: 886,883

[22] Filed: Jul. 2, 1997

[51] Int. Cl.[6] ..... H04R 25/00

[52] U.S. Cl. ..... 381/174; 381/191; 439/58

[58] Field of Search ..... 381/113, 116, 381/174, 191, 168, 169, 190; 439/58, 82; 367/170

[56] References Cited

U.S. PATENT DOCUMENTS 3,430,146 2/1969 Chua ..... 381/174

4,764,690 8/1988 Murphy et al. ..... 381/191

*Primary Examiner*—Huyen Le

*Attorney, Agent, or Firm*—Pro-Techtor Inter-National Services

[57] ABSTRACT

An assembling structure for capacitor microphone, in which an insertion seat is inserted on the circuit board and formed with two lateral through holes for respectively receiving two sleeves. The sleeve is disposed with two stopper sections on two sides, whereby when the sleeve is fitted in the through hole, the stopper sections serve to provide a stopping and locating effect so as to prevent the sleeve from rotating and loosening. The insertion pins of the capacitor microphone are tightly inserted in the sleeves. The assembling procedure of the microphone and the insertion seat can be automatically performed by a machine. The conducting ring in the restricting ring of the conducting plate is attached to the ring-shaped circuit formed by the fieldistor in the pad member to form a full electrical signal connection.

3 Claims, 3 Drawing Sheets

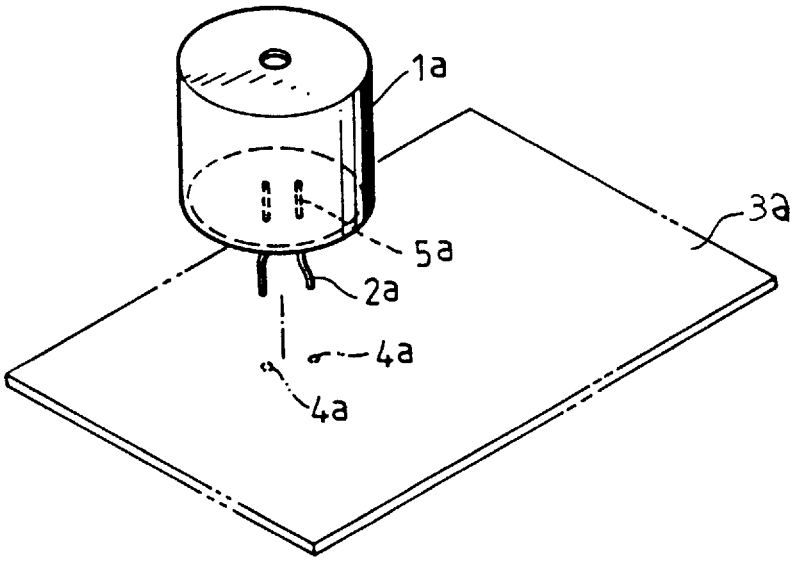
*FIG. 3* (PRIOR ART)

ASSEMBLING STRUCTURE FOR CAPACITOR MICROPHONE

BACKGROUND OF THE INVENTION

The present invention relates to an assembling structure for capacitor microphone, in which an insertion seat is inserted on the circuit board. The capacitor microphone can be tightly inserted with the capacitor microphone at high efficiency. The conducting structure in the microphone is improved to achieve stable quality and form a full electrical signal connection.

FIG. 3 shows a conventional capacitor microphone disposed on the circuit board of computer main frame for receiving sonic signal and processing and transforming the signal into electronic signal to the minimicrophone of the main frame. Several resonance structures are disposed in the casing 1*a* of the capacitor microphone for receiving and transforming the sonic signals. Two insertion pins 2*a* extends downward from the casing 1*a* for inserting into the insertion holes 4*a* of the circuit board 3*a*. Then by means of soldering, the capacitor microphone is fixed on the circuit board 3*a* by labor. Such assembling procedure is troublesome and time-consuming so that the production efficiency is relatively low.

The conducting structure in the casing 1*a* for connecting the signal includes two connecting pins 5*a* inward projecting from the pad member of the microphone for inserting with the conducting plates in the casing 1*a*. Such insertion pins 5*a* are subject to loosening and poor connection which lead to noise and interruption.

SUMMARY OF THE INVENTION

It is therefore a primary object of the present invention to provide an assembling structure for capacitor microphone, in which an insertion seat is inserted on the circuit board and formed with two lateral through holes for respectively receiving two sleeves. The sleeve is disposed with two stopper sections on two sides, whereby when the sleeve is fitted in the through hole, the stopper sections serve to provide a stopping and locating effect so as to prevent the sleeve from rotating and loosening. The insertion pins of the capacitor microphone are tightly inserted in the sleeves. The assembling procedure of the microphone and the insertion seat can be automatically performed by a machine.

It is a further object of the present invention to provide the above assembling structure in which a conducting ring is disposed in the restricting ring of the conducting plate and attached to the ring-shaped circuit formed by the fieldistor in the pad member to achieve stable quality and form a full electrical signal connection.

The present invention can be best understood through the following description and accompanying drawings, wherein:

BRIEF DESCRIPTION OF THE DRAWINGS

FIG. 3 is a perspective exploded view of the conventional capacitor microphone.

DETAILED DESCRIPTION OF THE PREFERRED EMBODIMENT

Figure 1:
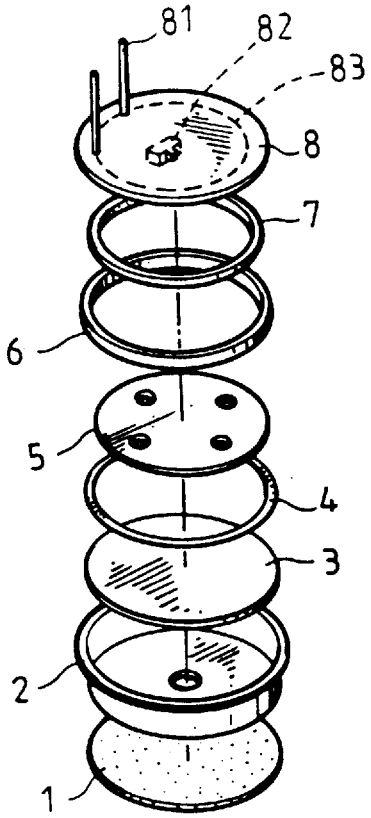
FIG. 1 is a perspective exploded view of the capacitor microphone of the present invention.

Please refer to FIG. 1. The present invention includes a dustproof plush 1, a casing seat 2, a plastic film 3, a ring-shaped vibration membrane 4, a conducting plate 5, a restricting ring 6, a metal conducting ring 7 and pad member 8. The dustproof plush 1 serves to provide dustproof and sound filtering effect. The plastic film 3 and the vibration membrane 4 serve to enhance the resonance effect. Two insertion pins 81 project from the surface of the pad member 8. A fieldistor circuit 82 is disposed in the microphone for transforming and receiving the signal so as to hear the voice. The present invention is characterized in that the conducting ring 7 in the restricting ring 6 is attached to the ring-shaped circuit 83 formed by the fieldistor 82 in the pad member 8 to form a full electrical signal connection so as to enhance the quality of the signal connection and avoid interruption and poor contact. The metal restricting ring 6 is fitted around the conducting ring 7 and located in the casing seat 2 to tightly contact with the ring-shaped circuit 83.

Figure 2:
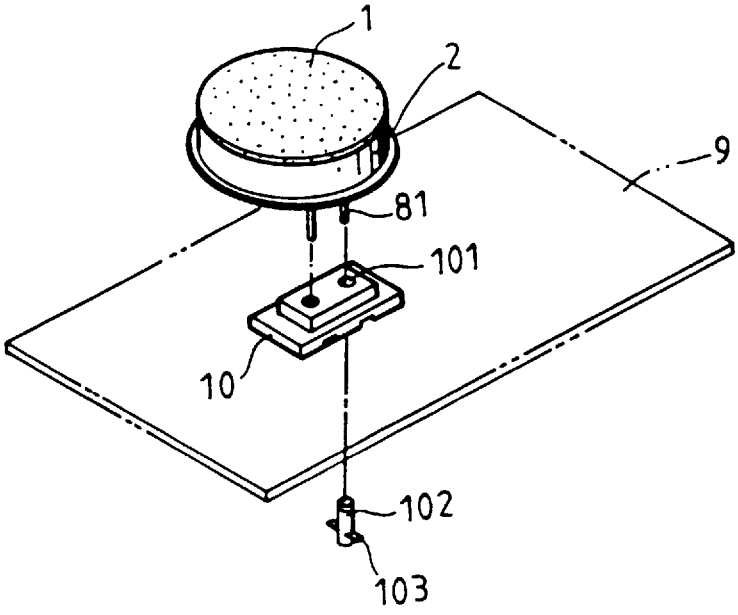
FIG. 2 is a perspective exploded view of the insertion seat and the capacitor microphone of the present invention.

FIG. 2 shows another character of the present invention, in which the insertion seat 10 is inserted on the circuit board 9 and formed with two lateral through holes 101 for respectively receiving two sleeves 102. The sleeve 102 is disposed with two stopper sections 103 on two sides, whereby when the sleeve 102 is fitted in the through hole 101, the stopper sections 103 serve to provide a stopping and locating effect so as to prevent the sleeve 102 from rotating and loosening. The insertion pins 81 of the capacitor microphone are tightly inserted in the sleeves 102. Also, the assembling procedure of the microphone and the insertion seat 1 can be automatically performed by a machine without labor. Therefore, the production efficiency is promoted and the quality of the product is enhanced.

It is to be understood that the above description and drawings are only used for illustrating one embodiment of the present invention, not intended to limit the scope thereof. Any variation and derivation from the above description and drawings should be included in the scope of the present invention.

What is claimed is:

1. An assembling structure for capacitor microphone, wherein the microphone comprises a dustproof plush, a casing seat, a plastic film, a ring-shaped vibration membrane, a conducting plate, a restricting ring, a metal conducting ring and pad member, the dustproof plush serving to provide dustproof and sound filtering effect, the plastic film and the vibration membrane serving to enhance the resonance effect, two insertion pins projecting from the surface of the pad member, a fieldistor circuit being disposed in the microphone for transforming and receiving the signal so as to hear the voice, the assembling structure having a circuit board and being characterized in that:

an insertion seat is inserted on the circuit board and formed with two lateral through holes for respectively receiving two sleeves, the sleeve being disposed with two stopper sections on two sides, whereby when the sleeve is fitted in the through hole, the stopper sections serve to provide a stopping and locating effect so as to prevent the sleeve from rotating and loosening, the insertion pins of the capacitor microphone being tightly inserted in the sleeves.

2. An assembling structure as claimed in claim 1, wherein the assembling procedure of the microphone and the insertion seat can be automatically performed by a machine.

3. An assembling structure as claimed in claim 1, wherein the conducting ring in the restricting ring of the conducting plate is attached to a ring-shaped circuit formed by the fieldistor in the pad member to form a full electrical signal connection.

* * * * *